US011330842B2

(12) United States Patent
Xu et al.

(10) Patent No.: US 11,330,842 B2
(45) Date of Patent: May 17, 2022

(54) VAPORIZATION DEVICE

(71) Applicant: SHENZHEN RELX TECHNOLOGY CO., LTD., Shenzhen (CN)

(72) Inventors: Shengyang Xu, Shenzhen (CN); Yiping Yuan, Shenzhen (CN); Hui Wang, Shenzhen (CN)

(73) Assignee: SHENZHEN RELX TECHNOLOGY CO., LTD., Shenzhen (CN)

( * ) Notice: Subject to any disclaimer, the term of this patent is extended or adjusted under 35 U.S.C. 154(b) by 155 days.

(21) Appl. No.: 16/777,901

(22) Filed: Jan. 31, 2020

(65) Prior Publication Data

US 2021/0084976 A1 Mar. 25, 2021

(30) Foreign Application Priority Data

Sep. 19, 2019 (CN) ..... 201910889317.8

(51) Int. Cl.
*A24F 40/46* (2020.01)
*A24F 40/42* (2020.01)

(52) U.S. Cl.
CPC ..... *A24F 40/46* (2020.01); *A24F 40/42* (2020.01)

(58) Field of Classification Search
None
See application file for complete search history.

(56) References Cited

U.S. PATENT DOCUMENTS

| | | | | |
|---|---|---|---|---|
| 2014/0109921 | A1 | 4/2014 | Chen | |
| 2018/0132533 | A1* | 5/2018 | Chen | A24F 40/485 |
| 2018/0263294 | A1 | 9/2018 | Qiu | |
| 2020/0015510 | A1* | 1/2020 | Dong | A24F 40/20 |
| 2020/0404979 | A1 | 12/2020 | Chen et al. | |
| 2021/0084975 | A1 | 3/2021 | Xu et al. | |
| 2021/0084976 | A1* | 3/2021 | Xu | A24F 40/46 |
| 2021/0106061 | A1 | 4/2021 | Wang et al. | |
| 2021/0177048 | A1 | 6/2021 | Li et al. | |

OTHER PUBLICATIONS

Office Action of corresponding U.S. Appl. No. 16/777,892 dated Jun. 24, 2021.

* cited by examiner

*Primary Examiner* — James Harvey
(74) *Attorney, Agent, or Firm* — Idea Intellectual Limited; Margaret A. Burke; Sam T. Yip

(57) ABSTRACT

This application relates to a vaporization device. The vaporization device includes a housing, a top cap, a heating assembly, and a storage compartment. The housing and the top cap define the storage compartment. The top cap surrounds the heating assembly.

19 Claims, 17 Drawing Sheets

VAPORIZATION DEVICE

CROSS REFERENCE TO RELATED APPLICATIONS

The present application claims the benefit of priority from the China Patent Application No. 201910889317.8, filed on 19 Sep. 2019, the disclosure of which is hereby incorporated by reference in its entirety.

BACKGROUND OF THE INVENTION

1. Field of the Invention

The present disclosure generally relates to a vaporization device, and in particular, to an electronic device that provides inhalable aerosol.

2. Description of the Related Art

An electronic cigarette is an electronic product that heats a vaporizable solution and vaporizes the solution to generate aerosol for a user to inhale. In recent years, major manufacturers begin to produce various electronic cigarette products. Generally, an electronic cigarette product includes a housing, an e-liquid storage chamber, a vaporization chamber, a heating assembly, an air inlet, an airflow channel, an air outlet, a power supply device, a sensing device, and a control device. The e-liquid storage chamber is configured to store a vaporizable (vaporizable) solution. The heating assembly is configured to heat the vaporizable solution and vaporize the solution to generate aerosol. The air inlet is in communication with the vaporization chamber, and a user supplies air to the heating assembly when inhaling. The aerosol generated by the heating assembly is first generated in the vaporization chamber, then flows through the airflow channel and the air outlet, and is finally inhaled by the user. The power supply device supplies power needed by the heating assembly, and the control device controls a heating time of the heating assembly based on an inhalation action of the user detected by the sensing device. The housing wraps each of the foregoing assemblies.

When the user uses an electronic cigarette, generated aerosol may condense in cavities or channels to form liquid. For example, the aerosol may condense in a cavity or a channel such as a vaporization chamber, an air inlet, an airflow channel, or an air outlet to form liquid. The liquid in such cavity or channel may leak when the user uses the electronic cigarette, and contaminate the user's clothes, pants, or other portable valuables, thereby causing bad user experience. With a continuous increase in use frequency, how to make the electronic cigarette better meet a requirement of the user through various improvements to improve user experience is an indispensable part for development of the electronic cigarette.

Therefore, a vaporization device that can resolve the problem is provided.

SUMMARY OF THE INVENTION

Some embodiments of this application provide a vaporization device. The provided vaporization device includes a housing, a top cap, and a heating assembly. The housing and the top cap define a storage compartment, and the top cap surrounds the heating assembly.

Some embodiments of this application provide a vaporization device. The provided vaporization device includes a housing, a heating assembly, and a top cap. The top cap is engaged with the housing and the heating assembly.

BRIEF DESCRIPTION OF THE DRAWINGS

The aspects of the disclosure will become more comprehensible from the following detailed description made with reference to the accompanying drawings. It should be noted that, various features may not be drawn to scale, and the sizes of the various features may be increased or reduced arbitrarily for the purpose of clear description.

The drawings and detailed descriptions use the same reference numerals to indicate same or similar elements. The features of the disclosure will be clearer from the detailed descriptions made with reference to the accompanying drawings.

PREFERRED EMBODIMENT OF THE PRESENT INVENTION

Figure 1A:
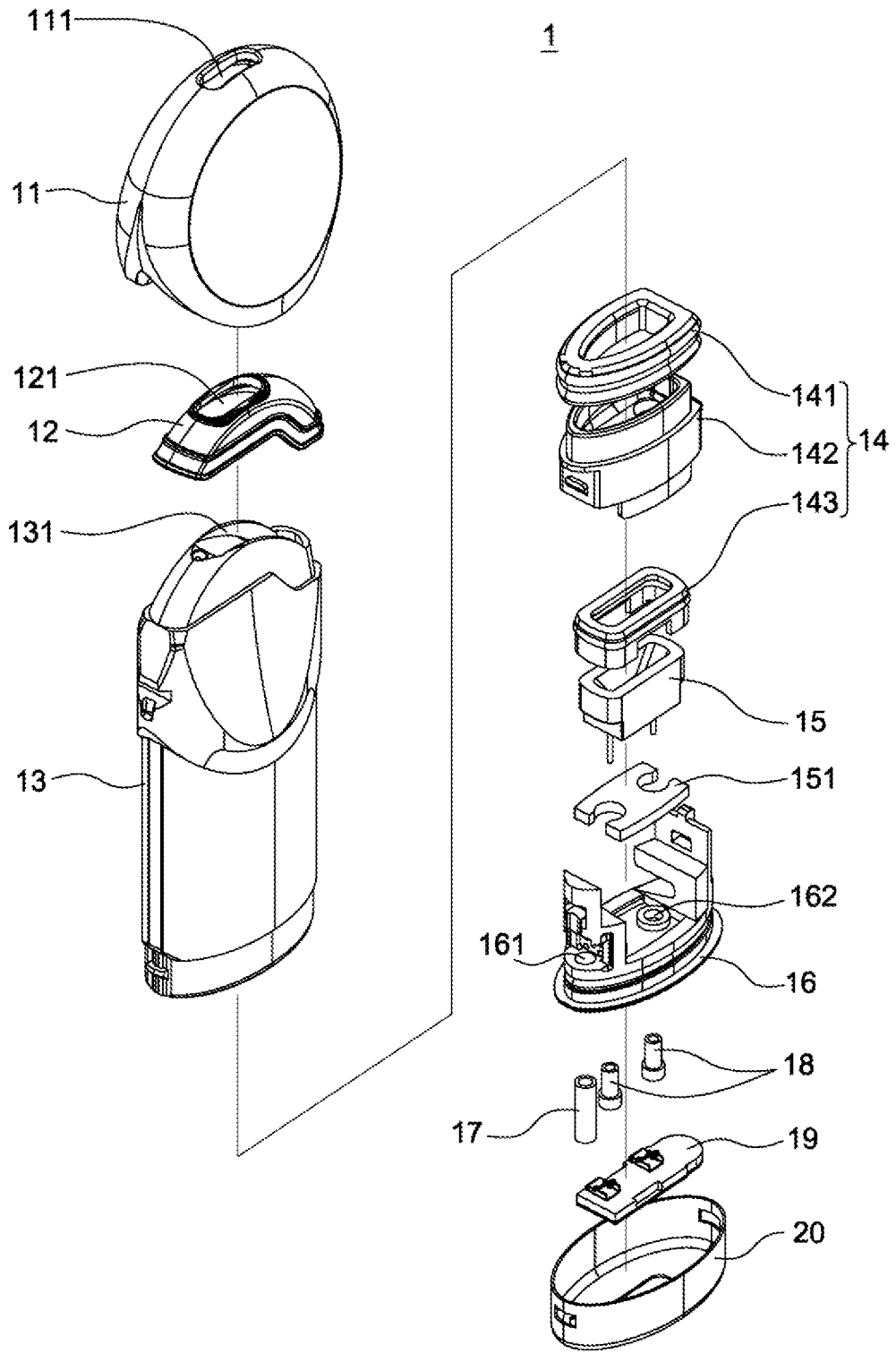
FIG. 1A and FIG. 1B are schematic diagrams of disassembled structures of a cartridge according to some embodiments of this application.

The following disclosed content provides many different embodiments or examples of different features used to implement the provided subject matters. The following disclosed content provides many different embodiments or examples of different features used to implement the provided subject matters. Certainly, these are merely examples and are not intended to be limitative. In the disclosure, in the following descriptions, reference formed by the first feature above or on the second feature may include an embodiment formed by direct contact between the first feature and the second feature, and may further include an embodiment in which an additional feature may be formed between the first feature and the second feature to enable the first feature and the second feature to be not in direct contact. In addition, in the disclosure, reference numerals and/or letters may be repeated in examples. This repetition is for the purpose of simplification and clarity, and does not indicate a relationship between the described various embodiments and/or configurations.

The embodiments of the disclosure are described in detail below. However, it should be understood that, the disclosure provides many applicable concepts that can be implemented in various particular cases. The described particular embodiments are only illustrative and do not limit the scope of the disclosure.

In some embodiments of this application, an electronic vaporizer device is also referred to as an electronic cigarette. The electronic vaporizer device includes an electronic vaporizer device body and an electronic vaporizer, the electronic vaporizer device body being also referred to as a tobacco rod (not shown), and the electronic vaporizer being also referred to as a cartridge 1. In some embodiments of this application, the cartridge and the tobacco rod are separate structural components, and the cartridge may be connected to the tobacco rod in a pluggable manner. The cartridge is engaged with the tobacco rod to form an electronic cigarette. In some embodiments of this application, the cartridge and the tobacco rod may be integrally formed structural components.

Figure 1B:
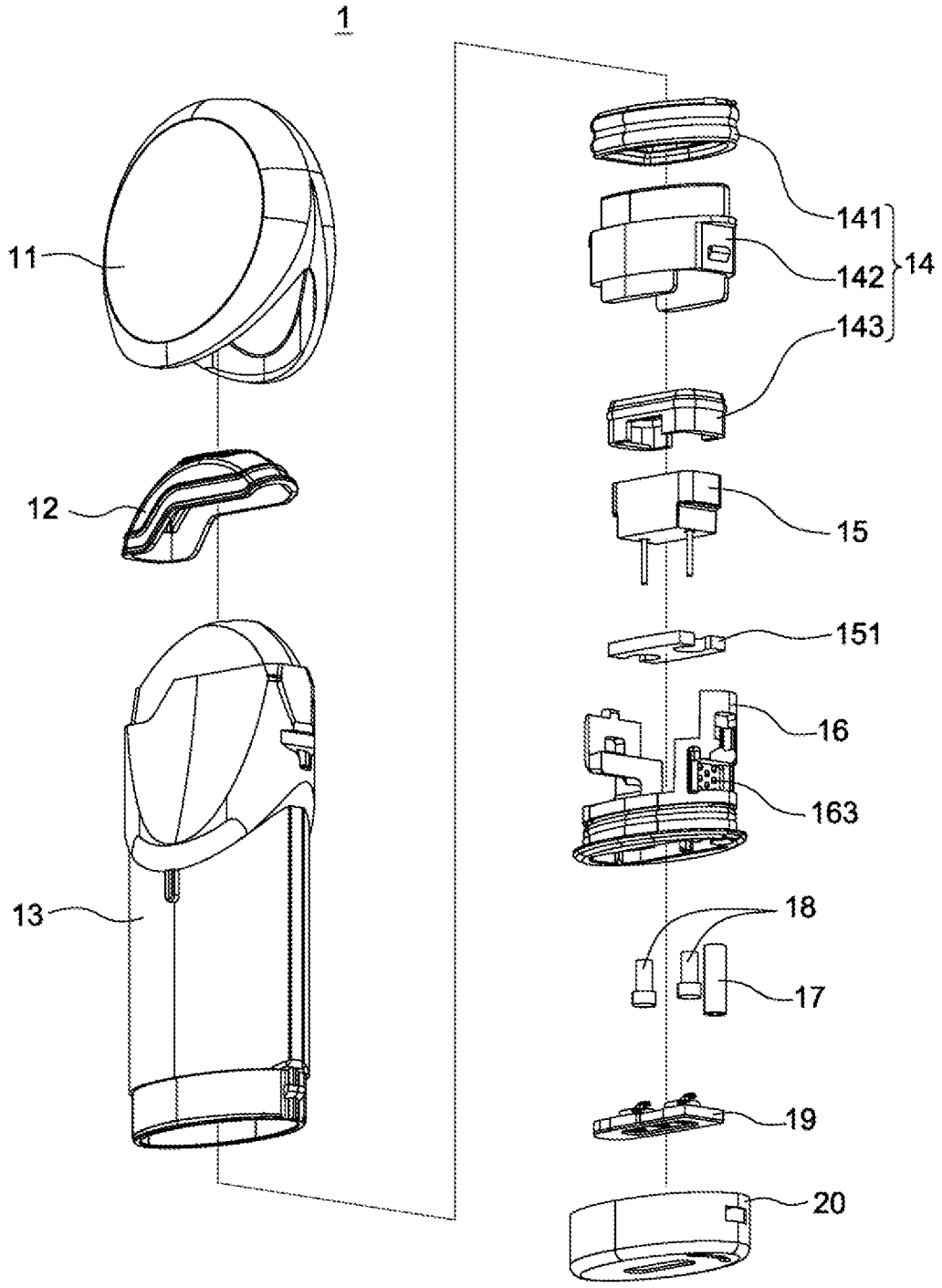

FIG. 1A and FIG. 1B are schematic diagrams of disassembled structures of a cartridge 1 according to some embodiments of this application. The cartridge 1 includes a mouthpiece 11, a cap 12, a housing 13, a top cap 14, a heating assembly 15, a heating base 16, a tube 17, an ejector pin 18, a printed circuit board (PCB) module 19, and a bottom cap 20. In some embodiments, the heating assembly 15, the ejector pin 18, and the PCB module 19 form a heating circuit in some embodiments of this application. In some embodiments, a resistor (not shown) indicating taste information of the cartridge 1 is disposed on the PCB module 19. In some embodiments, an encryption chip (not shown) is further disposed on the PCB module 19.

In some embodiments of this application, the cartridge 1 further includes a tar absorbing pad 151 located below the heating component 15. The tar absorbing pad 151 may be configured to absorb tobacco tar that may leak. The tar absorbing pad 151 is made of cotton, but a material may be selected according to an actual situation and is not limited thereto. Both sides of the tar absorbing pad 151 are provided with through holes or openings, the through holes or openings wrapping an outer wall at an upper half portion of the ejector pin 18.

The heating base 16 includes a hole 161, two holes 162, and a plurality of holes 163. The hole 161 is configured to accommodate the tube 17. When the cartridge 1 is assembled, the PCB module 19 is separated from the tube 17, and the PCB module 19 is not in direct contact with the tube 17. The two holes 162 are respectively configured to accommodate one ejector pin 18. Through the plurality of holes 163, the tube 17 may be in fluid communication with space in which a lower surface of the heating assembly 15, the tar absorbing pad 151, and the ejector pin 18 are located.

In some embodiments, the mouthpiece 11 has a hole 111, the cap 12 has a hole 121, and the housing 13 has a hole 131. When the mouthpiece 11, the cap 12, and the housing 13 are engaged with each other, the hole 111, the hole 121, and the hole 131 are in fluid communication with each other. A user may inhale gas containing a vaporized substance (for example, tobacco tar) from the hole 111 of the mouthpiece 11.

Referring to FIG. 1A and FIG. 1B, in some embodiments, the top cap 14 has an assembly 141, an assembly 142, and an assembly 143. In some embodiments, the assembly 141, the assembly 142, and the assembly 143 are made of different materials. In some embodiments, the assembly 141 and the assembly 143 may be made of a same material. In some embodiments, the assembly 142 is made of a material different from materials of the assembly 141 and the assembly 143.

Figure 2A:
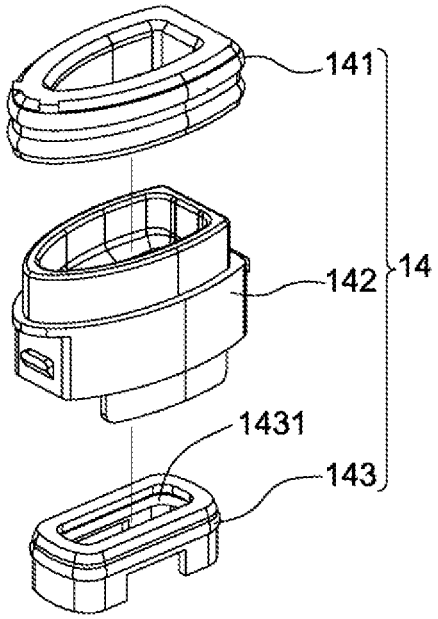
FIG. 2A and FIG. 2B are schematic diagrams of disassembled structures of a top cap according to some embodiments of this application.
Figure 2B:
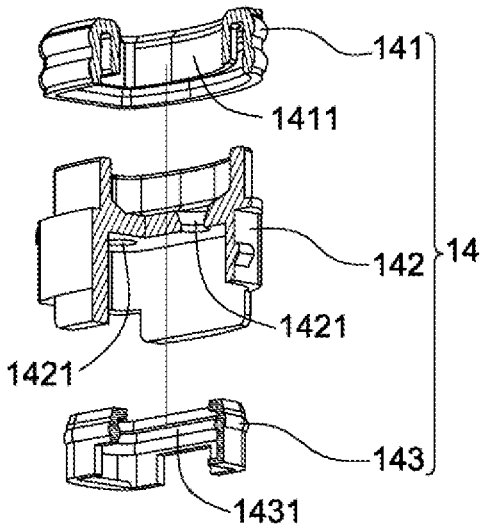

FIG. 2A and FIG. 2B are schematic diagrams of disassembled structures of a top cap 14 according to some embodiments of this application. The top cap 14 has an assembly 141, an assembly 142, and an assembly 143. The assembly 141 may be made of silica gel. The assembly 143 may be made of silica gel. The assembly 142 may be made of plastics. Material hardness of the assembly 142 may be higher than material hardness of the assembly 141. Material hardness of the assembly 142 may be higher than material hardness of the assembly 143.

The material hardness of the assembly 142 may be within a range from 65A to 75A of a Shore hardness type A. The material hardness of the assembly 142 may be within a range from 75A to 85A of the Shore hardness type A. The material hardness of the assembly 142 may be within a range from 85A to 90A of the Shore hardness type A. Material hardness of the assembly 141 may be within a range from 20A to 40A of the Shore hardness type A. The material hardness of the assembly 141 may be within a range from 40A to 60A of the Shore hardness type A. The material hardness of the assembly 141 may be within a range from 60A to 75A of the Shore hardness type A. Material hardness of the assembly 143 may be within a range from 20A to 40A of the Shore hardness type A. The material hardness of the assembly 143 may be within a range from 40A to 60A of the Shore hardness type A. The material hardness of the assembly 143 may be within a range from 60A to 75A of the Shore hardness type A.

The assembly 141, the assembly 142, and the assembly 143 of the top cap 14 may be combined together through later assembling. Therefore, assembly misalignment and a part tolerance problem may exist between the assembly 141, the assembly 142, and the assembly 143, further leading to a risk of liquid leakage (for example, tobacco tar leakage). A bonding force between the assembly 141 and the assembly 142 tends to be 0 N (that is, 0 Newton). A bonding force between the assembly 143 and the assembly 142 tends to be 0 N. For example, the assembly 141 and the assembly 142 that are combined with each other may be easily separated. The assembly 142 and the assembly 143 that are combined with each other may be easily separated.

The assembly 141 has a through hole 1411. The assembly 143 has a through hole 1431. When the assembly 141 is engaged with the assembly 142, the assembly 141 surrounds a portion of the assembly 142. When the assembly 142 is engaged with the assembly 143, a portion of the assembly 142 surrounds the assembly 143.

Referring to FIG. 2B, the assembly 142 has a through hole 1421. The assembly 141 has a through hole 1411. The assembly 143 has a through hole 1431. When the assembly 141, the assembly 142, and the assembly 143 are engaged with each other, the through hole 1411, the through hole 1421, and the through hole 1431 are in fluid communication with each other.

Again referring to FIG. 1A and FIG. 1B, when the top cap 14 is engaged with the housing 13, an inner surface of the housing 13 surrounds the assembly 141. When the top cap 14 is engaged with the heating assembly 15, the assembly 143 surrounds the heating assembly 15. When the top cap 14 is engaged with the heating assembly 15, the through hole 1431 of the assembly 143 may expose a portion of the heating assembly 15. When the top cap 14 is engaged with the heating assembly 15, the through hole 1431 of the assembly 143 may expose an upper surface of the heating assembly 15.

In some embodiments, the upper surface of the heating assembly 15 includes a groove. In some embodiments, a lower surface of the heating assembly 15 has two pins, each of the two pins of the heating assembly 15 being coupled to a corresponding ejector pin 18. The ejector pin 18 may be coupled to the PCB module 19.

Figure 3:
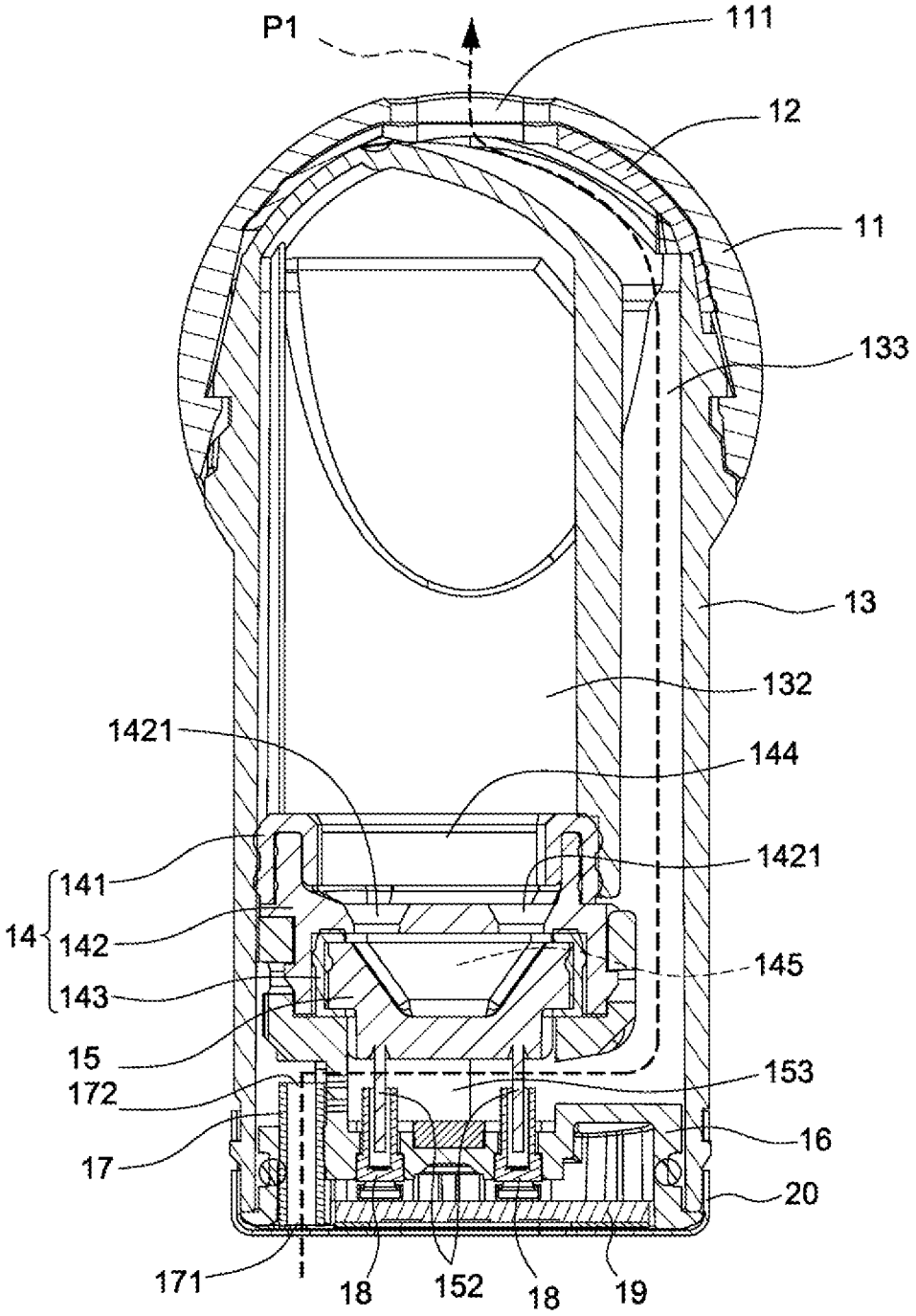
FIG. 3 is a schematic diagram of a cross-sectional structure of a cartridge according to some embodiments of this application.

FIG. 3 is a schematic diagram of a cross-sectional structure of a cartridge 1 according to some embodiments of this application. A housing 13 includes a storage compartment 132. The storage compartment 132 is configured to store a to-be-vaporized fluid substance, such as tobacco tar. A top cap 14 (including an assembly 141, an assembly 142, and an assembly 143) is engaged with the housing 13. In some embodiments, the housing 13 and the top cap 14 define the storage compartment 132. When the top cap 14 is engaged with the housing 13, an inner surface of the housing 13 surrounds the assembly 141 of the top cap 14. In some embodiments, the housing 13 defines the storage compartment 132. When the top cap 14 is engaged with the housing 13, an inner surface of the storage compartment 132 surrounds the assembly 141 of the top cap 14. The top cap 14 (including the assembly 141, the assembly 142, and the assembly 143) is engaged with a heating assembly 15. When the top cap 14 is engaged with the heating assembly 15, the assembly 143 of the top cap 14 surrounds the heating assembly 15.

The top cap 14 defines an opening 144. The assembly 141 and the assembly 142 of the top cap 14 define the opening 144. The top cap 14 defines an opening 145. An upper surface of the heating assembly 15 has a groove. The opening 145 of the top cap 14 and the groove on the upper surface of the heating assembly 15 define a cavity. The assembly 141 and the assembly 142 of the top cap 14 and the upper surface of the heating assembly 15 define the opening 145. The assembly 141 and the assembly 142 of the top cap 14 and the groove on the upper surface of the heating assembly 15 define the opening 145.

The storage compartment 132 is in fluid communication with the opening 144. The opening 144 is in fluid communication with the opening 145. The opening 144 is in fluid communication with the opening 145 through a through hole 1421. The storage compartment 132, the opening 144, and the opening 145 are in fluid communication with each other. The storage compartment 132, the opening 144, the opening 145, and the groove on the upper surface of the heating assembly 15 are in fluid communication with each other.

Figure 5A:
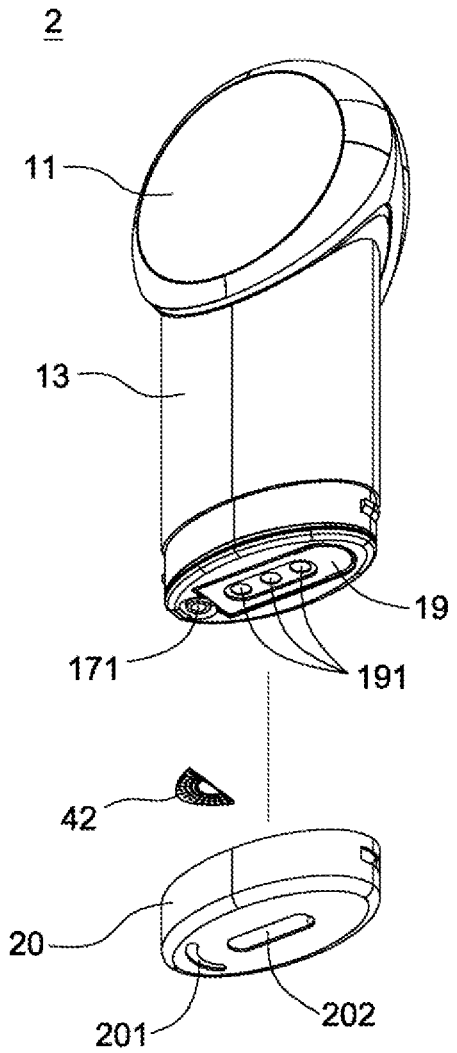
FIG. 5A is a schematic diagram of a disassembled structure of a cartridge according to some embodiments of this application.

The heating assembly 15 includes two pins 152. The pins 152 are coupled to an ejector pin 18. A tube 17 extends from a bottom cap 20 toward the heating assembly 15. The tube 17 includes two ends. The two ends of the tube 17 each have an opening 171 and an opening 172. The tube 17 extends and partially penetrates through a heating base 16. A hole 161 (as shown in FIG. 1A) of the heating base 16 accommodates the tube 17. The opening 171 of the tube 17 defines an opening on a bottom surface of the heating base 16. The opening 171 of the tube 17 is exposed to the bottom surface of the heating base 16. The heating base 16 includes the opening 171 of the tube 17. A through hole 201 (as shown in FIG. 5A) of the bottom cap 20 exposes the opening 171. The opening 171 and the opening 172 of the tube 17 are in communication with external fluid.

A dashed arrow in FIG. 3 shows an outlet passage P1 of a cartridge 1. The external fluid (such as air) flows in from the opening 171 of the tube 17, flows through the tube 17, and flows out from the opening 172 of the tube 17. The air flowing out from the opening 172 of the tube 17 flows through a plurality of holes 163 (as shown in FIG. 1B) of the heating base 16 to a vaporization chamber 153. The vaporization chamber 153 is defined by a lower portion of the heating assembly 15, the pins 152, and the ejector pin 18. The lower portion of the heating assembly 15 is exposed to the vaporization chamber 153. Aerosol generated by heating of the heating assembly 15 is mixed with air, and the aerosol mixed with the air flows through a passage 133 of the housing 13 to a hole 131 (as shown in FIG. 1A) of the housing 13 and a hole 121 (as shown in FIG. 1A) of a cap 12, and then flows to a hole 111 of a mouthpiece 11 to be sucked by a user. When the user uses a vaporization device, vaporized tobacco tar is mixed with cold air, which may condense the vaporized tobacco tar. Condensed tobacco tar may be absorbed by the tar absorbing pad 151 to prevent the tobacco tar from spilling out of the cartridge 1. However, the condensed tobacco tar may not be completely absorbed by the tar absorbing pad 151 and may spill out of the cartridge 1 through the tube 17.

Figure 4A:
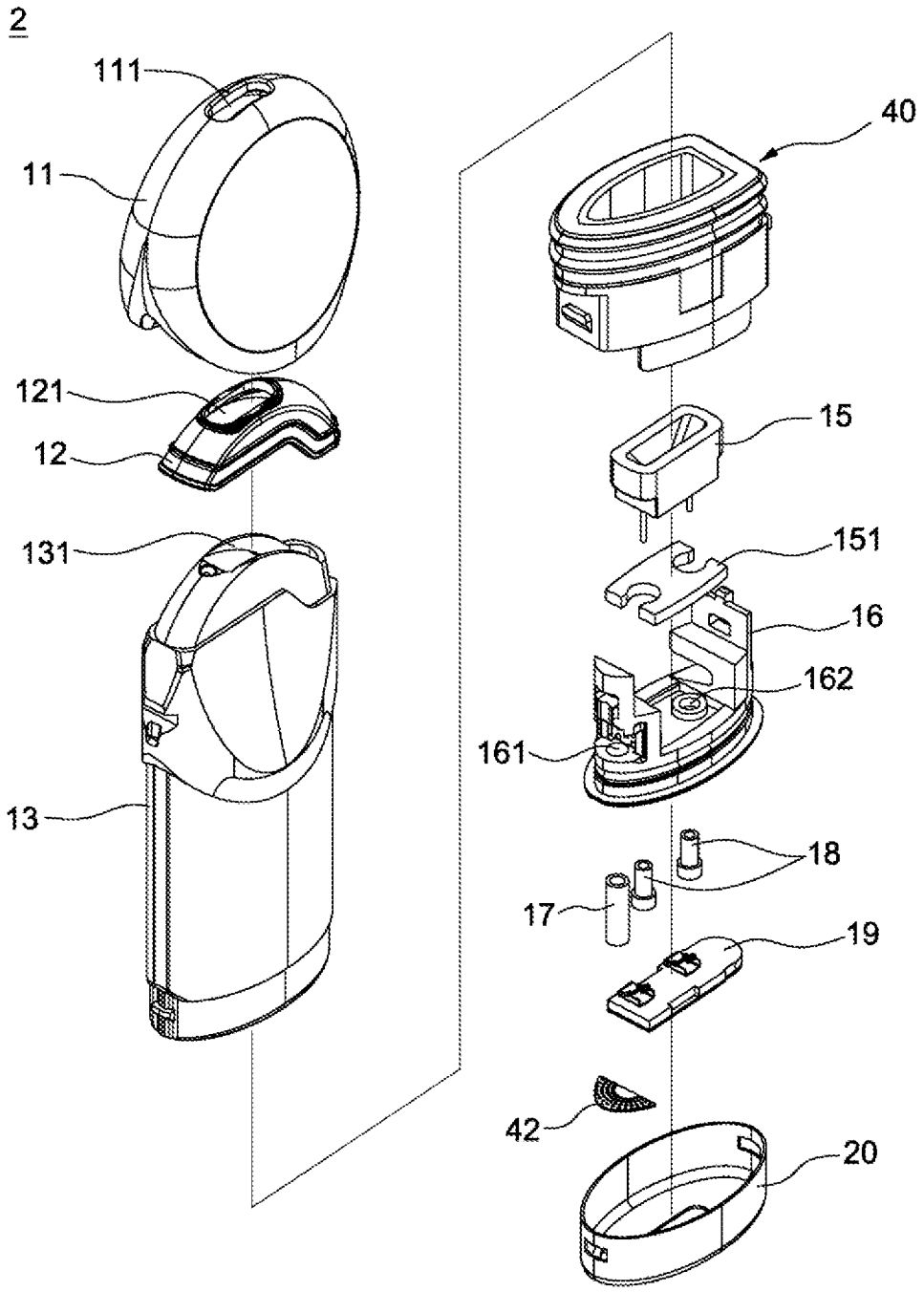
FIG. 4A and FIG. 4B are schematic diagrams of disassembled structures of a cartridge according to some embodiments of this application.
Figure 4B:
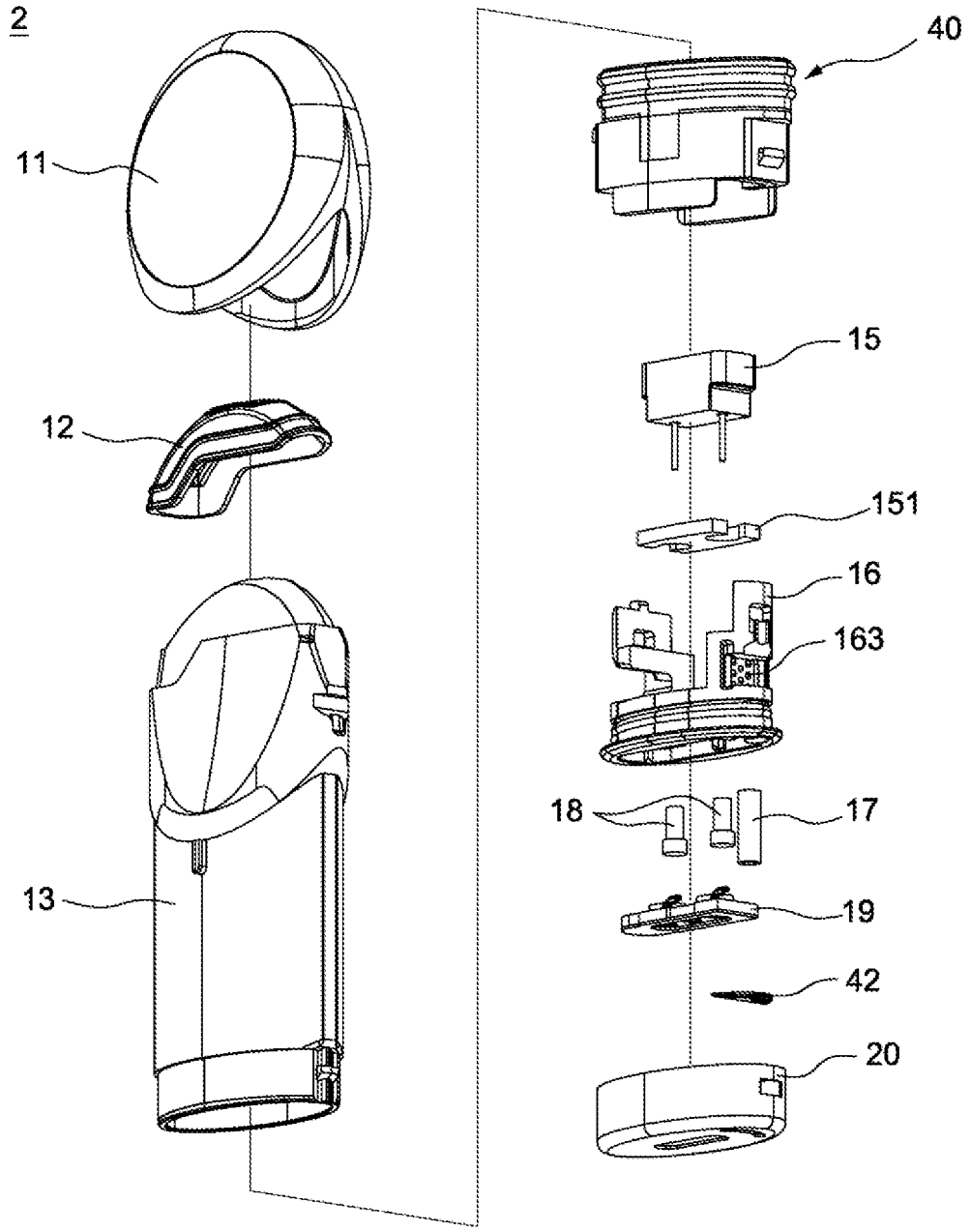

FIG. 4A and FIG. 4B are schematic diagrams of disassembled structures of a cartridge 2 according to some embodiments of this application Similar to the cartridge 1 shown in FIG. 1A, FIG. 1B, and FIG. 3, the cartridge 2 in FIG. 4A and FIG. 4B includes a mouthpiece 11, a cap 12, a housing 13, a heating assembly 15, a heating base 16, a tube 17, an ejector pin 18, a printed circuit board (PCB) module 19, a bottom cap 20, a top cap 40, and a filter screen 42. In some embodiments, the heating assembly 15, the ejector pin 18, and the PCB module 19 form a heating circuit in some embodiments of this application. In some embodiments, a resistor (not shown) indicating taste information of the cartridge 2 is disposed on the PCB module 19. In some embodiments, an encryption chip (not shown) is further disposed on the PCB module 19.

In some embodiments of this application, the cartridge 2 further includes a tar absorbing pad 151 located below the heating assembly 15. The tar absorbing pad 151 may be configured to absorb tobacco tar that may leak. The tar absorbing pad 151 is made of cotton, but a material may be selected according to an actual situation and is not limited thereto. Both sides of the tar absorbing pad 151 are provided with through holes or openings, the through holes or openings wrapping an outer wall at an upper half portion of the ejector pin 18.

The heating base 16 includes a hole 161, two holes 162, and a plurality of holes 163. The hole 161 is configured to accommodate the tube 17. When the cartridge 1 is assembled, the PCB module 19 is separated from the tube 17, and the PCB module 19 is not in direct contact with the tube 17. The two holes 162 are respectively configured to accommodate one ejector pin 18. Through the plurality of holes 163, the tube 17 may be in fluid communication with space in which a lower surface of the heating assembly 15, the tar absorbing pad 151, and the ejector pin 18 are located.

In some embodiments, the mouthpiece 11 has a hole 111, the cap 12 has a hole 121, and the housing 13 has a hole 131. When the mouthpiece 11, the cap 12, and the housing 13 are engaged with each other, the hole 111, the hole 121, and the hole 131 are in fluid communication with each other. A user may inhale gas containing a vaporized substance (for example, tobacco tar) from the hole 111 of the mouthpiece 11.

The tube 17 shown in FIG. 4A and FIG. 4B has two ends, one end including an opening 171 close to the bottom cap 20 and the other end including an opening 172 (as shown in FIG. 3) close to the heating assembly 15. A tube 17 extends from a bottom cap 20 toward the heating assembly 15. The tube 17 includes two ends. The two ends of the tube 17 each have an opening 171 and an opening 172. The tube 17 extends and penetrates through the heating base 16. A hole 161 (as shown in FIG. 4A) of the heating base 16 accommodates the tube 17. The opening 171 of the tube 17 defines an opening on a bottom surface of the heating base 16. The opening 171 of the tube 17 is exposed to the bottom surface of the heating base 16. The heating base 16 includes the opening 171 of the tube 17. A through hole 201 (as shown in FIG. 5A) of the bottom cap 20 exposes the opening 171. The opening 171 and the opening 172 of the tube 17 are in communication with external fluid.

The cartridge 2 shown in FIG. 4A and FIG. 4B also includes the passage P1 shown in FIG. 3. The external fluid (such as air) flows in from the opening 171 of the tube 17, flows through the tube 17, and flows out from the opening 172 of the tube 17. The fluid flowing out from the opening 172 of the tube 17 flows through the plurality of holes 163 (as shown in FIG. 1B) of the heating base 16 to space in which a lower surface of the heating assembly 15, pins 152, and the ejector pin 18 are located. The external fluid (such as air) flows through a passage 133 of the housing 13 to the hole 131 (as shown in FIG. 1A) of the housing 13 and the hole 121 (as shown in FIG. 1A) of the cap 12, and then flows to the hole 111 of the mouthpiece 11.

Figure 6:
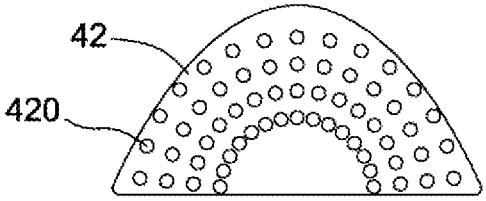
FIG. 6 is a schematic diagram of a filter screen according to some embodiments of this application.

FIG. 5A is a schematic diagram of a disassembled structure of a cartridge 2 according to some embodiments of this application. A heating base 19 includes three contacts 191. The contacts 191 and an opening 171 are located on a bottom surface of the heating base 19. A bottom cap 20 includes a through hole 201 and a through hole 202. A filter screen 42 is located between a housing 13 and the bottom cap 20. The filter screen 42 is located between the heating base 19 and the bottom cap 20. The filter screen 42 is located between the bottom cap 20 and the opening 171 at one end of a tube 17. The filter screen 42 covers the opening 171. The filter screen 42 covers the through hole 201. The through hole 201 exposes the filter screen 42. The through hole 201 exposes a micropore 420 (as shown in FIG. 6) of the filter screen 42. The through hole 202 exposes the contacts 191. In some embodiments, if the filter screen 42 is not used, the through hole 201 exposes the opening 171.

In some embodiments, the filter screen 42 may be made of a same material as a material of the heating base 19. In some embodiments, the filter screen 42 may be made of a material different from the material of the heating base 19. In some embodiments, the filter screen 42 may be made of a same material as a material of the bottom cap 20. In some embodiments, the filter screen 42 may be made of a material different from the material of the bottom cap 20. In some embodiments, the filter screen 42 may be made of a metal material. In some embodiments, the filter screen 42 may be made of a plastic material.

Figure 5B:
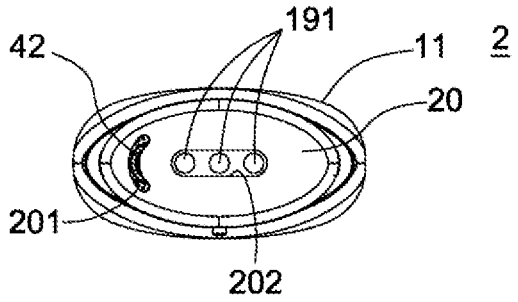
FIG. 5B is a bottom view of a cartridge according to some embodiments of this application.

FIG. 5B is a bottom view of a cartridge 2 according to some embodiments of this application. The through hole 201 of the bottom cap 20 exposes the micropore 420 of the filter screen 42. The through hole 202 of the bottom cap 20 exposes the contacts 191.

According to the cartridge 2 in FIG. 4A, FIG. 4B, FIG. 5A, and FIG. 5B, when the user inhales, air flows through the passage P1 shown in FIG. 3. When the air flows through a vaporization chamber 153, vaporized tobacco tar is mixed with cold air, which may condense the vaporized tobacco tar. Tobacco tar that is not completely absorbed by a tar absorbing pad 151 may spill out of the cartridge 2. The filter screen 42 is disposed, so that the cartridge 2 may prevent condensed tobacco tar from leaking out of the cartridge 2 through the tube 17.

The filter screen 42 and the micropore 420 are in fluid communication with the passage P1. The filter screen 42 and the micropore 420 are in fluid communication with the vaporization chamber 153 (a lower portion of the heating assembly 15 is exposed to the vaporization chamber 153). The filter screen 42 and the micropore 420 are in fluid communication with the heating assembly 15. The condensed tobacco tar may spill out and flow to the tube 17. If the condensed tobacco tar spills out and flows to the tube 17, the micropore 420 on the filter screen 42 will block the condensed tobacco tar.

FIG. 6 is a schematic diagram of a filter screen 42 according to some embodiments of this application. In some embodiments, the filter screen 42 may be of a semi-elliptical shape. A shape of the filter screen 42 may conform to a contour of a bottom cap 20. The shape of the filter screen 42 includes a circular shape, a semi-circular shape, a triangular shape, or a rectangular shape. The thickness of the filter screen 42 is within a range from 0.1 mm to 0.5 mm. The area of the filter screen 42 is within a range from 3 $mm^2$ to 30 $mm^2$. The filter screen 42 may be made of stainless steel or nylon. The filter screen 42 includes a plurality of micropores 420. A diameter of one micropore 420 is within a range from 0.01 mm to 0.2 mm. The area of the micropore 420 is less than the area of a through hole 201 of the bottom cap 20. A sum of the areas of the plurality of micropores 420 is within a range from 0.7 $mm^2$ to 4 $mm^2$. If condensed tobacco tar spills into a tube 17, due to surface tension of the tobacco tar, the micropores 420 on the filter screen 42 will block the condensed tobacco tar.

Figure 7A:
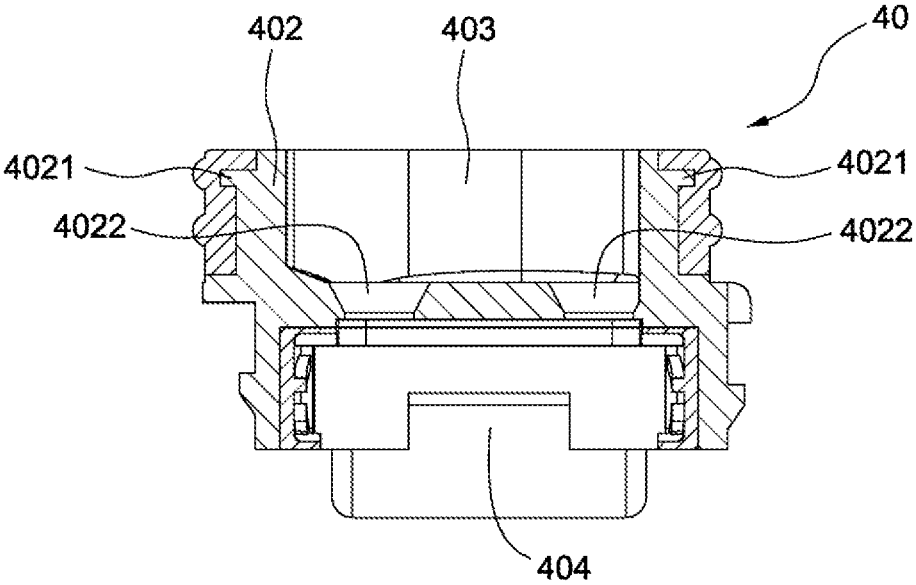
FIG. 7A is a schematic cross-sectional view of a top cap according to some embodiments of this application.

FIG. 7A is a schematic cross-sectional view of a top cap 40 according to some embodiments of this application. The top cap 40 includes a portion 401 and a portion 402. The portion 401 and the portion 402 are made of different materials. The portion 401 may be made of an elastic material, for example, silica gel or ceramic silica gel. The portion 402 may be made of plastics. Material hardness of the portion 402 is higher than material hardness of the portion 401. Shore hardness of a silica gel material of the portion 401 is within a range from 40A to 50A. The portion 401 may be made of liquid silica gel. The portion 401 may be fixed to the portion 402 through secondary injection molding. The portion 401 may be made of liquid silica gel, and is attached to the portion 402 by applying an adhesive. The portion 401 may be made of self-adhesive liquid silica gel, the self-adhesive liquid silica gel being solidified after being applied to the portion 402. The portion 401 and the portion 402 may be assembled into a top cap 40 through injection molding assembly. A bonding force between the portion 401 and the portion 402 is within a range from 0.1 $N/cm^2$ (Newton/square millimeter) to 20 $N/cm^2$. Because the portion 401 and the portion 402 may be assembled into the top cap 40 through injection molding assembly, assembly misalignment and a part tolerance problem do not exist between the portion 401 and the portion 402, thereby avoiding a risk of liquid leakage (for example, tobacco tar leakage).

The portion 402 of the top cap 40 includes a flange 4021 and two through holes 4022. The flange 4021 increases the bonding force between the portion 401 and the portion 402. Because the portion 401 and the portion 402 are assembled through injection molding assembly, the flange 4021 is fully engaged with the portion 401. The portion 401 may wrap a portion of the flange 4021. The portion 401 may completely wrap the flange 4021.

An upper portion of the top cap 40 defines an opening 403. A lower portion of the top cap 40 defines an opening 404. The upper portion of the portion 402 of the top cap 40 defines the opening 403. The lower portion of the portion 402 of the top cap 40 defines the opening 404. The opening 403 is in fluid communication with the opening 404 through a through hole 4022.

Figure 7B:
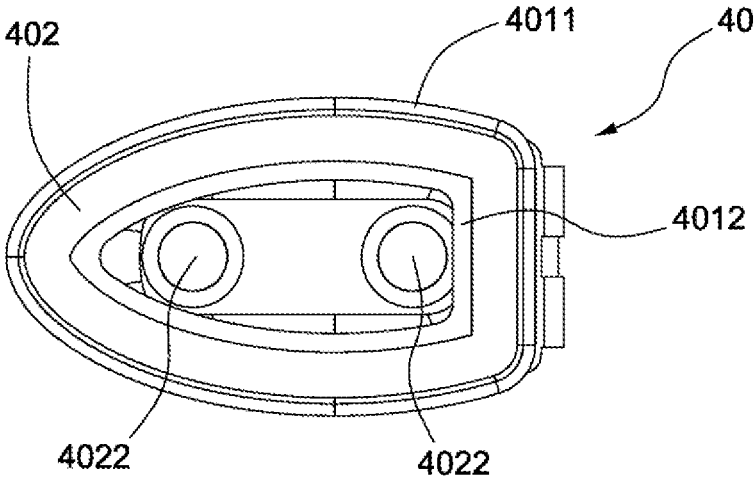
FIG. 7B is a top view of a top cap according to some embodiments of this application.

FIG. 7B is a top view of a top cap 40 according to some embodiments of this application. The portion 401 includes a first portion 4011 and a second portion 4012. The first portion 4011 surrounds an outer surface of the portion 402. The second portion 4012 surrounds an inner surface of the portion 402. The first portion 4011 surrounds an outer side of the opening 403. The second portion 4012 surrounds an inner side of the opening 404. The portion 402 includes two through holes 4022.

Figure 7C:
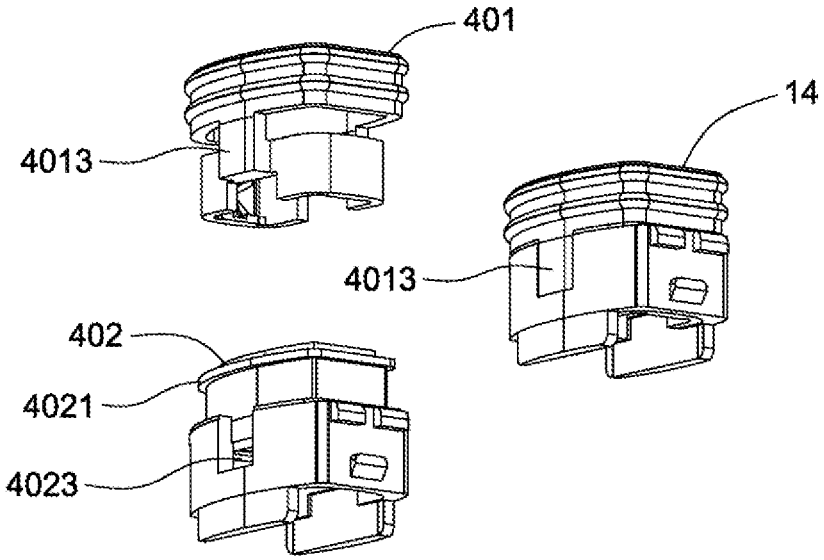
FIG. 7C to FIG. 7F are schematic diagrams of disassembled structures of a top cap according to some embodiments of this application.

FIG. 7C is a schematic diagram of a disassembled structure of a top cap 40 according to some embodiments of this application. The top cap 40 includes a portion 401 and a portion 402. The portion 401 includes a pair of protrusions 4013. The portion 402 includes a flange 4021 and a pair of perforations 4023. Because the portion 401 and the portion 402 are assembled through injection molding assembly, the flange 4021 is fully engaged with the portion 401, to increase a bonding force between the portion 401 and the portion 402. The protrusions 4013 respectively correspond to the perforations 4023. Because the portion 401 and the portion 402 are assembled through injection molding assembly, the pair of protrusions 4013 are respectively formed in the corresponding perforations 4023, to increase the bonding force between the portion 401 and the portion 402. The top cap 40 is shown on the right of FIG. 7C. The protrusions 4013 penetrate through the portion 402 through the perforations 4023 and are exposed. In some embodiments, the portion 401 may include one, three, four, or more protrusions 4013, and the portion 402 may accordingly include one, three, four, or more perforations 4023.

Figure 7D:
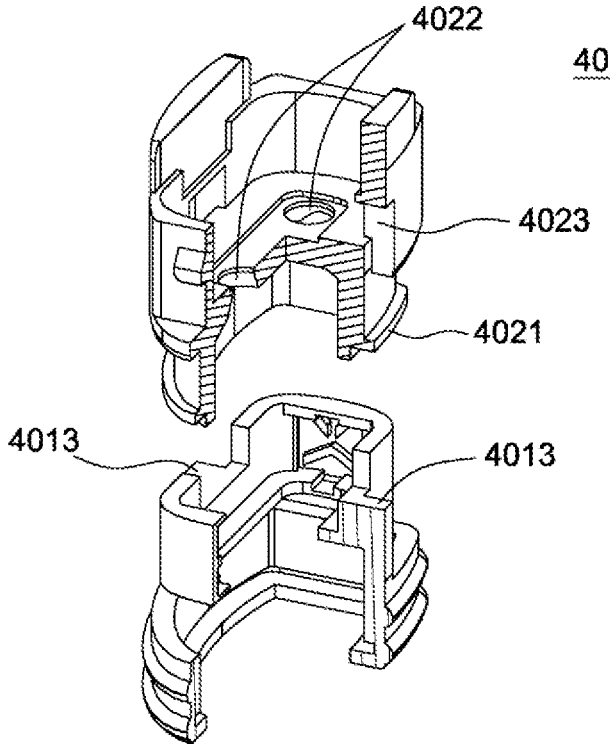

FIG. 7D is a schematic diagram of a disassembled structure of a top cap 40 according to some embodiments of this application. The top cap 40 includes a portion 401 and a portion 402. The portion 401 includes a pair of protrusions 4013. The portion 402 includes a flange 4021 and a pair of perforations 4023. Because the portion 401 and the portion 402 are assembled through injection molding assembly, the flange 4021 is fully engaged with the portion 401, to increase a bonding force between the portion 401 and the portion 402. The protrusions 4013 respectively correspond to the perforations 4023. Because the portion 401 and the portion 402 are assembled through injection molding assembly, the pair of protrusions 4013 are respectively formed in the corresponding perforations 4023, to increase the bonding force between the portion 401 and the portion 402.

Figure 7E:
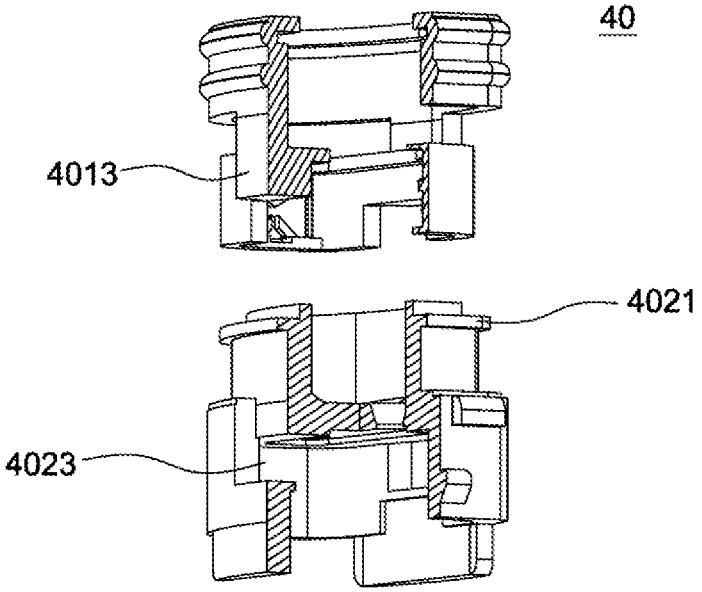

FIG. 7E is a schematic diagram of a disassembled structure of a top cap 40 according to some embodiments of this application. The top cap 40 includes a portion 401 and a portion 402. The portion 401 includes a pair of protrusions 4013. The portion 402 includes a flange 4021 and a pair of perforations 4023. Because the portion 401 and the portion 402 are assembled through injection molding assembly, the flange 4021 is fully engaged with the portion 401, to increase a bonding force between the portion 401 and the portion 402. The protrusions 4013 respectively correspond to the perforations 4023. Because the portion 401 and the portion 402 are assembled through injection molding assembly, the pair of protrusions 4013 are respectively formed in the corresponding perforations 4023, to increase the bonding force between the portion 401 and the portion 402.

According to the cartridge 2 in FIG. 4A and FIG. 4B, the portion 401 is located between the flange 4021 and an inner surface of the housing 13 (see FIG. 3). According to the cartridge 2 in FIG. 4A and FIG. 4B, a first portion 4011 of the portion 401 is located between the flange 4021 and the inner surface of the housing 13 (see FIG. 3). According to the cartridge 2 in FIG. 4A and FIG. 4B, the portion 401 is located between the flange 4021 and the inner surface of the storage compartment 132 (see FIG. 3). According to the cartridge 2 in FIG. 4A and FIG. 4B, the first portion 4011 of the portion 401 is located between the flange 4021 and the inner surface of the storage compartment 132 (see FIG. 3).

Figure 7F:
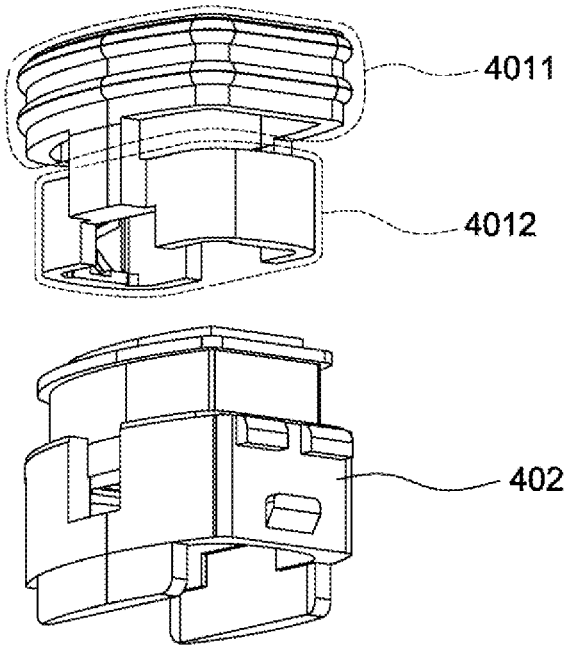

FIG. 7F is a schematic diagram of a disassembled structure of a top cap 40 according to some embodiments of this application. The top cap 40 includes a portion 401 and a portion 402. The portion 401 includes a first portion 4011 and a second portion 4012. According to the cartridge 2 in FIG. 4A and FIG. 4B, the inner surface of the housing 13 surrounds the portion 401 of the top cap 40 (see FIG. 3), the portion 401 of the top cap 40 surrounding the heating assembly 15 (see FIG. 3). According to the cartridge 2 in FIG. 4A and FIG. 4B, the inner surface of the housing 13 surrounds the first portion 4011 of the portion 401 (see FIG. 3), and the second portion 4012 of the portion 401 surrounds the heating assembly 15 (see FIG. 3). According to the cartridge 2 in FIG. 4A and FIG. 4B, the inner surface of the storage compartment 132 surrounds the portion 401 of the top cap 40 (see FIG. 3), the portion 401 of the top cap 40 surrounding the heating assembly 15 (see FIG. 3). According to the cartridge 2 in FIG. 4A and FIG. 4B, the inner surface of the storage chamber 132 surrounds the first portion 4011 of the portion 401 (see FIG. 3), and the second portion 4012 of the portion 401 surrounds the heating assembly 15 (see FIG. 3).

Figure 8:
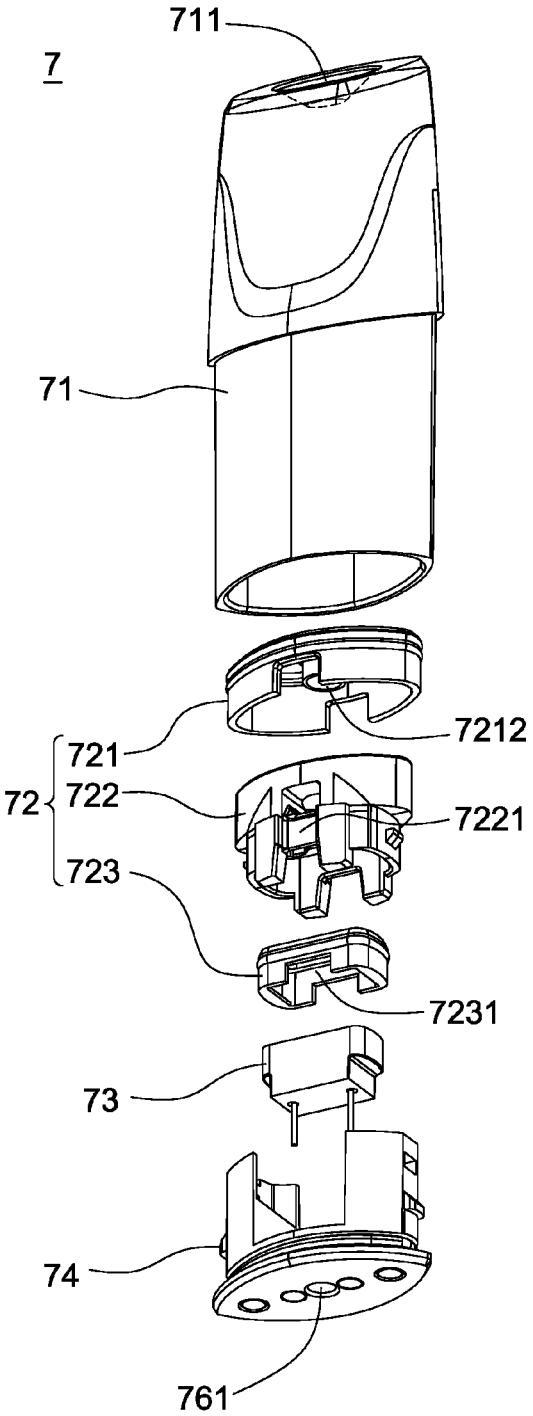
FIG. 8 is a schematic diagram of a disassembled structure of a cartridge according to some embodiments of this application.

FIG. 8 is a schematic diagram of a disassembled structure of a cartridge 7 according to some embodiments of this application. The cartridge 7 includes a housing 71, a top cap 72, a heating assembly 73, and a heating base 74. The housing 71 includes a passage 711. A lower surface of the heating base 74 has an opening 761. The top cap 72 includes a sealing assembly 721, a body assembly 722, and a sealing assembly 723. The sealing assembly 721 includes an opening 7212, an opening 7213, and an opening 7214 (see FIG. 10). The body assembly 722 includes a groove 7221, an opening 7222, an opening 7223, an opening 7224, and an opening 7225. The sealing assembly 723 includes an opening 7231.

In some embodiments, the sealing assembly 721, the body assembly 722, and the sealing assembly 723 are made of different materials. In some embodiments, the sealing assembly 721 and the sealing assembly 723 may be made of a same material. In some embodiments, the body assembly 722 is made of a material different from a material of the sealing assembly 721 and the sealing assembly 723. The sealing assembly 721 may be made of silica gel. The sealing assembly 723 may be made of silica gel. The body assembly 722 may be made of plastics. Material hardness of the body assembly 722 is higher than material hardness of the sealing assembly 721. Material hardness of the body assembly 722 is higher than material hardness of the sealing assembly 723. The material hardness of the sealing assembly 721 is within a range from 55A to 65A of Shore hardness. The material hardness of the sealing assembly 723 is within a range from 55A to 65A of Shore hardness. The sealing assembly 721, the body assembly 722, and the sealing assembly 723 of the top cap 72 are assembled together through later assembling. Therefore, assembly misalignment and a part tolerance problem may occur among the sealing assembly 721, the body assembly 722, and the sealing assembly 723, further leading to a risk of liquid leakage (for example, tobacco tar leakage). A bonding force between the sealing assembly 721 and the body assembly 722 tends to be 0 N (that is, 0 Newton). A bonding force between the sealing assembly 723 and the body assembly 722 tends to be 0 N.

Figure 9:
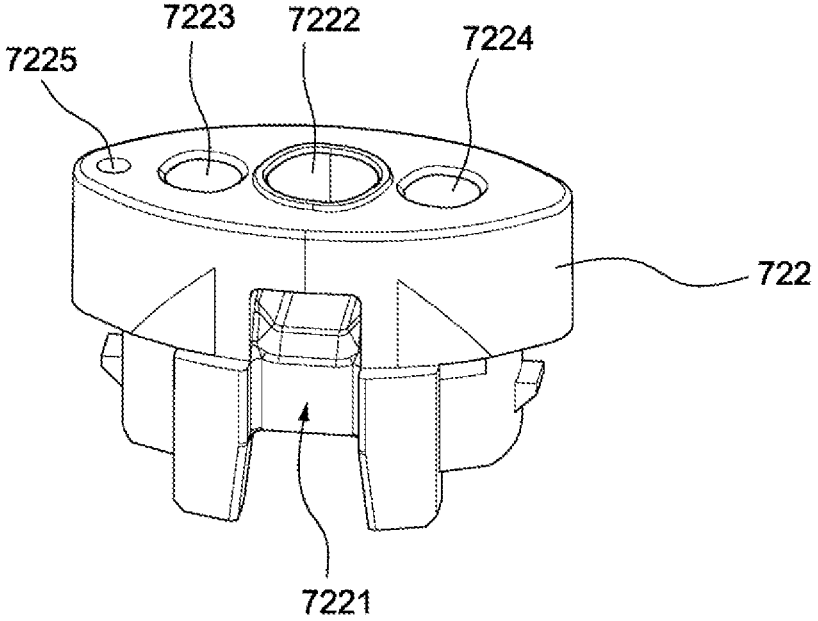
FIG. 9 is a three-dimensional view of an assembly of a top cap according to some embodiments of this application.
Figure 10:
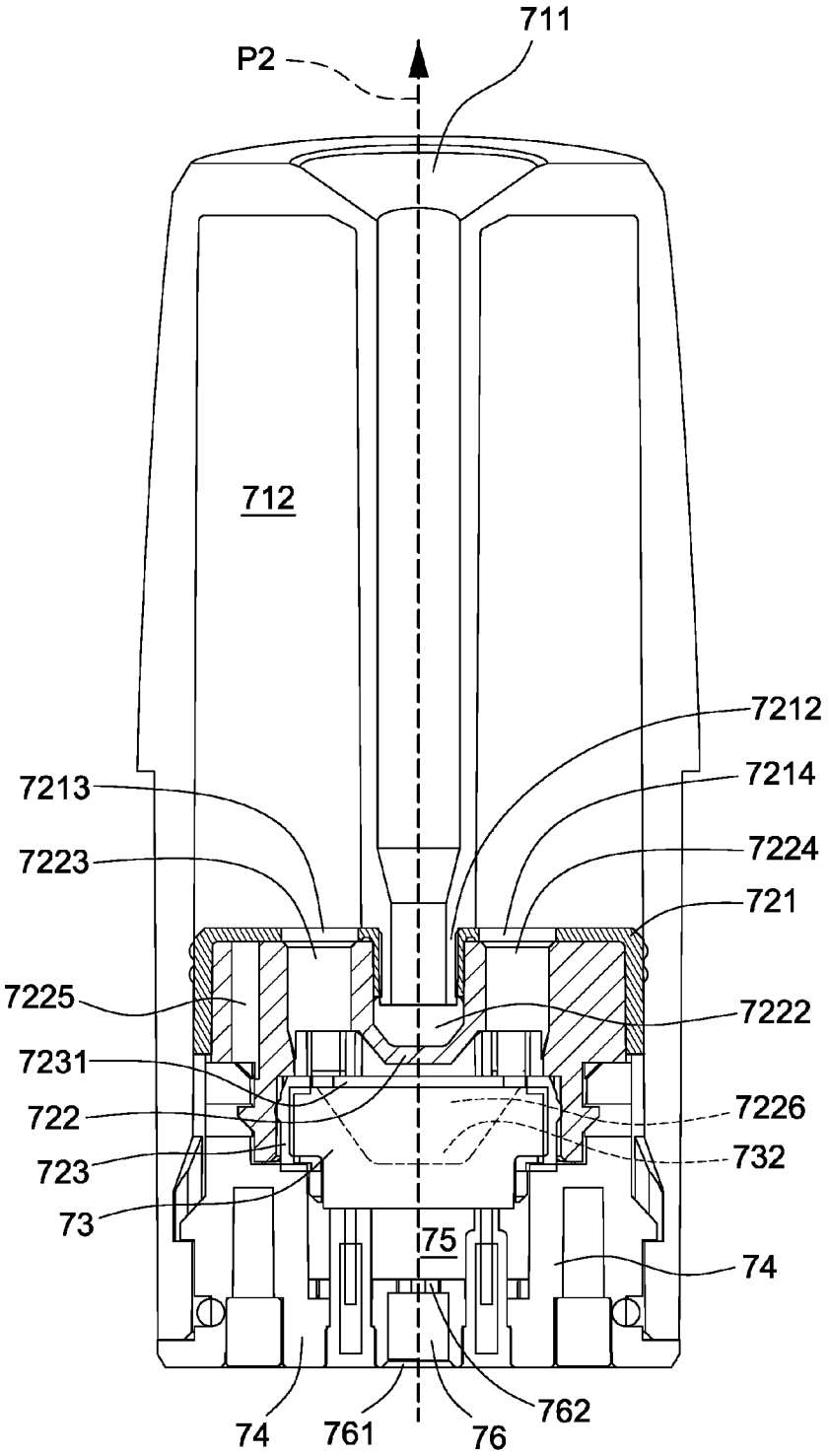
FIG. 10 is a sectional view of a cartridge according to some embodiments of this application.

FIG. 9 is a three-dimensional view of a body assembly 722 according to some embodiments of this application. The body assembly 722 includes an opening 7222, an opening 7223, an opening 7224, and an opening 7225. The opening 7225 extends into the body assembly 722 (as shown in FIG. 10). The opening 7223 extends into the body assembly 722 (as shown in FIG. 10). The opening 7224 extends into the body assembly 722 (as shown in FIG. 10). The opening 7225 extends into the body assembly 7225 (as shown in FIG. 10). In some embodiments, the body assembly 722 may have more openings. In some embodiments, the body assembly 722 may have fewer openings. The body assembly 722 has a groove 7221. The groove 7221 is in fluid communication with the opening 7222. The groove 7221 is in fluid communication with a vaporization chamber 75 (as shown in FIG. 10).

FIG. 10 is a cross-sectional diagram of a cartridge 7 according to some embodiments of this application. A housing 71 includes a passage 711 and a storage compartment 712. The storage compartment 712 is configured to store a to-be-vaporized fluid substance, such as tobacco tar. A body assembly 722 of a top cap 72 has an opening 7222, an opening 7223, an opening 7224, and an opening 7225. A sealing assembly 721 of the top cap 72 has an opening 7212, an opening 7213, and an opening 7214. The opening 7212, the opening 7213, and the opening 7214 each correspond to the opening 7222, the opening 7223, and the opening 7224.

The opening 7213, the opening 7214, the opening 7223, the opening 7224, and the opening 7231 are in fluid communication with each other. A lower portion of a body assembly 722 defines an opening 7226. The body assembly 722 and the assembly 723 define the opening 7226. The body assembly 722 and the opening 7231 (see FIG. 8) of the sealing assembly 723 define the opening 7226. The opening 7226 and an upper surface of a heating assembly 73 define space 732. The opening 7226 and an upper groove of the heating assembly 73 define the space 732. The storage compartment 712 is in fluid communication with the opening 7213, the opening 7214, the opening 7223, the opening 7224, and the opening 7231. The opening 7213, the opening 7214, the opening 7223, the opening 7224, the opening 7231, and the opening 7226 are in fluid communication with each other. The opening 7226 is in fluid communication with the space 732.

The cartridge 7 includes a tube 76. The tube 76 includes two ends, one end having an opening 761 and the other end having an opening 762. In some embodiments, the tube 76 may include a plurality of openings 762.

The opening 761 is exposed to a heating base 74 (as shown in FIG. 8). The opening 762 is close to the heating assembly 73. A vaporization chamber 75 is defined between the heating base 74 and the heating assembly 73. A lower portion of the heating assembly 73 is exposed to the vaporization chamber 75. Aerosol generated by heating of the heating assembly 73 is formed in the vaporization chamber 75. The aerosol generated by heating of the heating assembly 73 is sucked by a user through the passage 711 of the tube. The passage 711 is in fluid communication with the vaporization chamber 75. The groove 7221 (as shown in FIG. 9) is in fluid communication with the vaporization chamber 75.

A dashed arrow in FIG. 10 shows an outlet passage P2 of the cartridge 7. The external fluid (such as air) flows in from the opening 761 of the tube 76, flows through the tube 76, and flows out from the opening 762 of the tube 76. Air flowing out of the opening 762 of the tube 76 flows into the vaporization chamber 75 at the lower portion of a heating assembly 73. Aerosol generated by heating of the heating assembly 73 is mixed with air, and the aerosol mixed with the air flows through the passage 711 of the housing 71 to be sucked by the user. When the user inhales, air flows through the vaporization chamber 75 at the lower portion of the heating assembly 73, and vaporized tobacco tar is mixed with cold air, which may condense the vaporized tobacco tar and may cause the tobacco tar to spill out of the cartridge 7. The condensed tobacco tar may alternatively spill out of a cartridge 1 through the tube 76.

Figure 11:
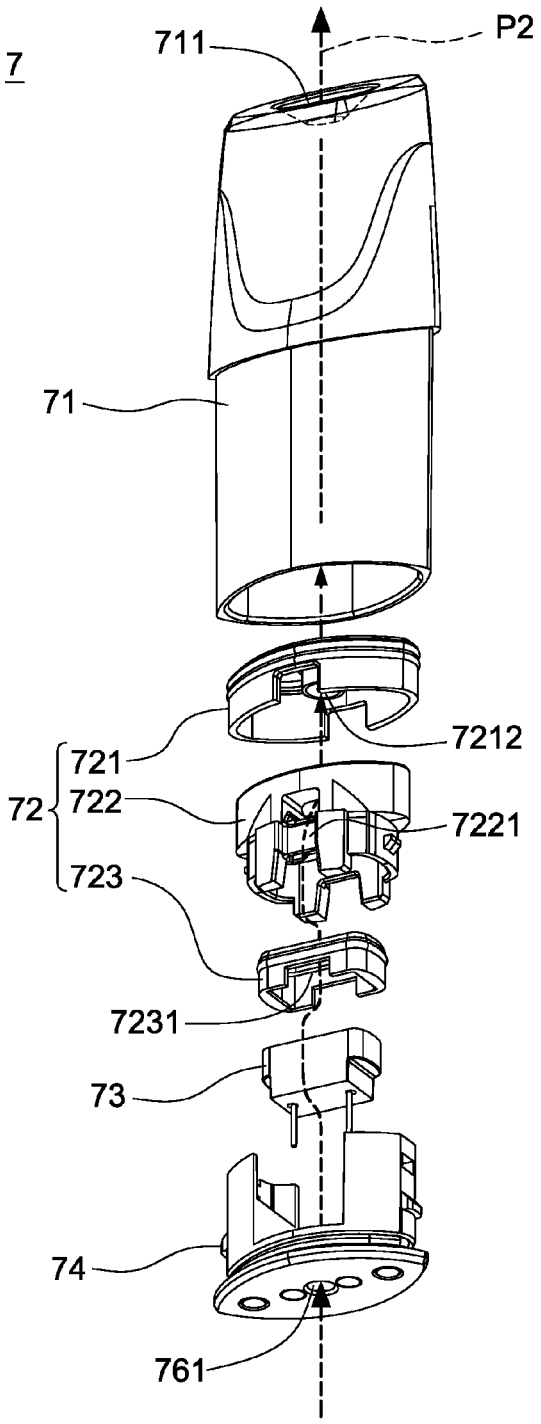
FIG. 11 is a schematic diagram of a disassembled structure of a cartridge according to some embodiments of this application.

FIG. 11 is a schematic diagram of a disassembled structure of a cartridge 7 according to some embodiments of this application. A plurality of dashed arrows in FIG. 11 show an outlet passage P2 of a cartridge 7. The external fluid (such as air) flows in from the opening 761 of the tube 76, flows through the tube 76, and flows out from the opening 762 of the tube 76. Air flowing out from the opening 762 of the tube 76 flows into a vaporization chamber 75 at a lower portion of a heating assembly 73. Aerosol generated by heating of the heating assembly 73 is mixed with air, and the aerosol mixed with the air flows through a groove 7221 and then openings 7222 and 7212 to a passage 711 of a housing 71 to be sucked by a user. A passage P2 shown in FIG. 10 and FIG. 11 does not pass through the space 732, the opening 7226, and the opening 7231. When the user inhales, the air flows through the vaporization chamber 75 of the lower portion of the heating assembly 73, heated and vaporized tobacco tar is mixed with air, which may condense the vaporized tobacco tar, and the tobacco tar may spill out of the cartridge 7. The condensed tobacco tar may alternatively spill out of a cartridge 1 through the tube 76.

Figure 12A:
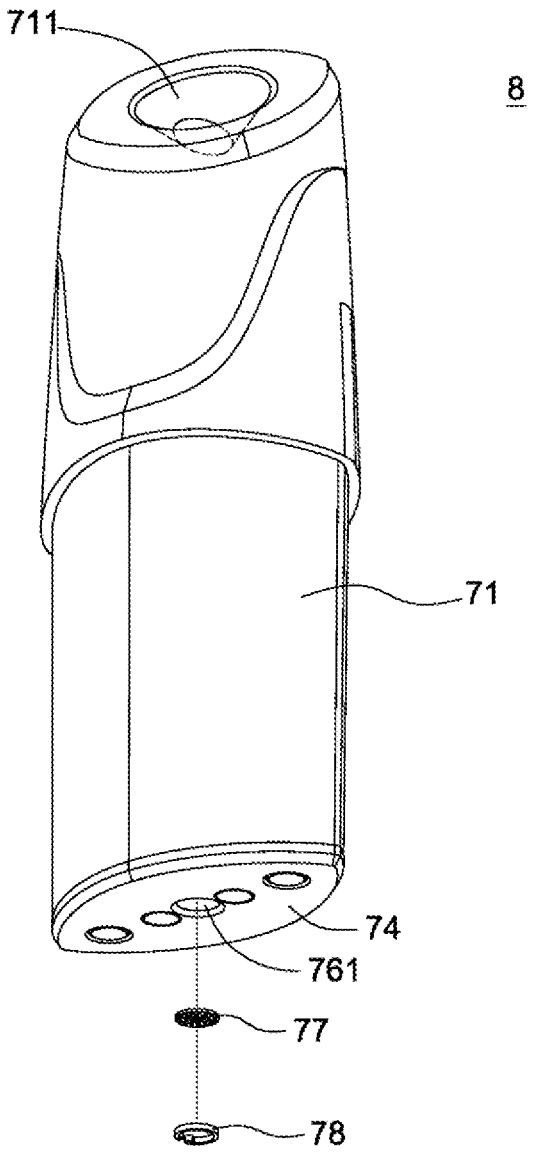
FIG. 12A is a schematic diagram of a disassembled structure of a cartridge according to some embodiments of this application.

FIG. 12A is a schematic diagram of a disassembled structure of a cartridge 8 according to some embodiments of this application. An opening 761 is exposed to a surface of a heating base 74. A filter screen 77 covers the opening 761. A metal ring 78 fixes the filter screen 77 to the opening 761. The filter screen 77 and a micropore 770 are exposed to an exterior of the cartridge 8. According to the cartridge 8 in FIG. 12A, when the user inhales, air flows through a passage P2 shown in FIG. 10 and FIG. 11. When air flows through a vaporization chamber 75 (a lower portion of a heating assembly 15 is exposed to a vaporization chamber 153) at a lower portion of a heating assembly 73, heated and vaporized tobacco tar is mixed with air, which may condense the vaporized tobacco tar. The filter screen 77 and the micropore 770 are in fluid communication with a passage P2. The filter screen 77 and the micropore 770 are in fluid communication with the vaporization chamber 75 (a lower portion of the heating assembly 73 is exposed to the vaporization chamber 75). The filter screen 77 and the micropore 770 are in fluid communication with the heating assembly 75. The condensed tobacco tar may spill out and flow to the tube 76 and flow to the opening 761. If the condensed tobacco tar spills out and flows to the opening 761, the micropore 770 (as shown in FIG. 14) on the filter screen 77 will block the condensed tobacco tar.

Figure 12B:
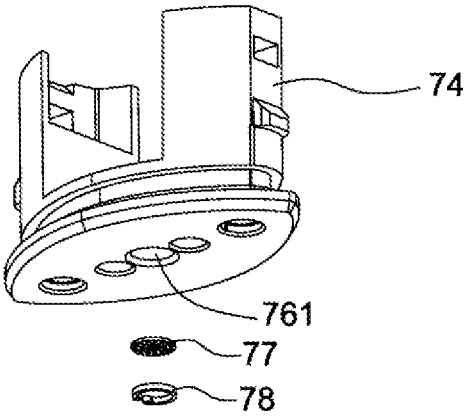
FIG. 12B is a schematic diagram of a disassembled structure of a heating base of a cartridge according to some embodiments of this application.

FIG. 12B is a schematic diagram of a disassembled structure of a heating base 74 of a cartridge 8 according to some embodiments of this application. An opening 761 is exposed to a surface of a heating base 74. A filter screen 77 covers the opening 761. A ring 78 fixes the filter screen 77 to the opening 761. The ring 78 may be made of a metal or plastic material. The filter screen 77 and a micropore 770 are exposed to an exterior of the cartridge 8.

Figure 13:
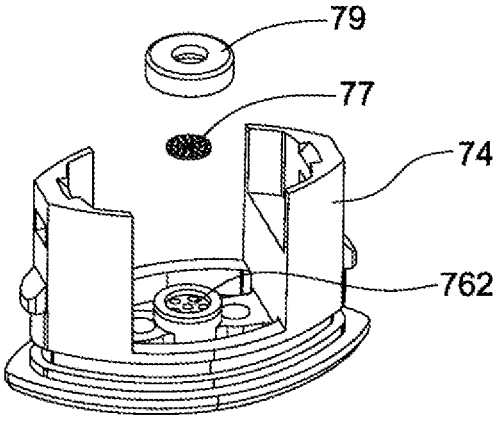
FIG. 13 is a schematic diagram of a disassembled structure of a heating base of a cartridge according to some embodiments of this application.

FIG. 13 is a schematic diagram of a disassembled structure of a heating base 74 of a cartridge 8 according to some embodiments of this application. An opening 762 is located on a surface on the heating base 74. The opening 762 is close to a surface of a heating assembly 73. A filter screen 77 covers the opening 762. A ring 79 fixes the filter screen 77 to the opening 762. The ring 79 may be made of a metal or plastic material. The filter screen 77 and a micropore 770 penetrates through an opening 761 of a tube 76 and is exposed to an exterior of the cartridge 8. According to the heating base 74 in FIG. 13, when the user inhales, air flows through a passage P1 shown in FIG. 10 and FIG. 11. When air flows through a vaporization chamber 75 (a lower portion of a heating assembly 15 is exposed to a vaporization chamber 153) at a lower portion of a heating assembly 73, heated and vaporized tobacco tar is mixed with air, which may condense the vaporized tobacco tar. The filter screen 77 and the micropore 770 are in fluid communication with a passage P2. The filter screen 77 and the micropore 770 are in fluid communication with the vaporization chamber 75 (a lower portion of the heating assembly 73 is exposed to the vaporization chamber 75). The filter screen 77 and the micropore 770 are in fluid communication with the heating assembly 75. The condensed tobacco tar may spill out and flow to the opening 762 of the tube 76. If the condensed tobacco tar spills out and flows to the opening 762 of the tube 76, the micropore 770 (as shown in FIG. 14) on the filter screen 77 will block the condensed tobacco tar. The filter screen 77 may prevent tobacco tar from leaking from the tube 76 to the cartridge 8.

Figure 14:
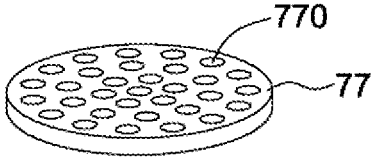
FIG. 14 is a schematic diagram of a filter screen according to some embodiments of this application.

FIG. 14 is a schematic diagram of a filter screen 77 according to some embodiments of this application. In some embodiments, the filter screen 77 may be of a circular shape. A shape of the filter screen 77 may conform to a contour of an opening 761 or an opening 762 of a tube 76. The shape of the filter screen 77 includes a circular shape, a semicircular shape, a triangular shape, a rectangular shape, or a polygonal shape. The thickness of the filter screen 77 is within a range from 0.1 mm to 0.5 mm. The area of the filter screen 77 is within a range from 3 $mm^2$ to 30 $mm^2$. The filter screen 77 may be made of stainless steel or nylon. The filter screen 77 includes a plurality of micropores 770. A diameter of one micropore 770 is within a range from 0.01 mm to 0.2 mm. The area of the micropore 770 is less than the area of the opening 761 or the area of the opening 762. A sum of areas of the plurality of micropores 770 is within a range from 0.7 $mm^2$ to 4 $mm^2$. If condensed tobacco tar spills out and flows to the opening 761 or flows to the opening 762 of the tube 76, due to surface tension of the tobacco tar, the micropores 770 on the filter screen 77 will block the condensed tobacco tar. The filter screen 77 may prevent tobacco tar from leaking from the tube 76 to the cartridge 8.

Throughout the specification, references to "embodiment", "part of embodiments", "one embodiment", "another example", "example", "specific example" or "part of examples" mean that at least one embodiment or example of the present application includes specific features, structures, or characteristics described in the embodiment or example. Thus, the descriptions appear throughout the specification, such as "in some embodiments," "in an embodiment," "in one embodiment," "in another example," "in an example," "in a particular example" or "for example," are not necessarily the same embodiment or example in the application.

As used herein, space-related terms such as "under", "below", "lower portion", "above", "upper portion", "lower portion", "left side", "right side", and the like may be used herein to simply describe a relationship between one component or feature and another component or feature as shown in the figures. In addition to orientation shown in the figures, space-related terms are intended to encompass different orientations of the device in use or operation. An apparatus may be oriented in other ways (rotated 90 degrees or at other orientations), and the space-related descriptors used herein may also be used for explanation accordingly. It should be understood that when a component is "connected" or "coupled" to another component, the component may be directly connected to or coupled to another component, or an intermediate component may exist.

As used herein, the terms "approximately", "basically", "substantially", and "about" are used to describe and explain small variations. When used in combination with an event or a situation, the terms may refer to an example in which an event or a situation occurs accurately and an example in which the event or situation occurs approximately. As used herein with respect to a given value or range, the term "about" generally means in the range of ±10%, ±5%, ±1%, or ±0.5% of the given value or range. The range may be indicated herein as from one endpoint to another endpoint or between two endpoints. Unless otherwise specified, all ranges disclosed herein include endpoints. The term "substantially coplanar" may refer to two surfaces within a few micrometers (μm) positioned along the same plane, for example, within 10 μm, within 5 μm, within 1 μm, or within 0.5 μm located along the same plane. When reference is made to "substantially" the same numerical value or characteristic, the term may refer to a value within ±10%, ±5%, ±1%, or ±0.5% of the average of the values.

As used herein, the terms "approximately", "basically", "substantially", and "about" are used to describe and explain small variations. When used in combination with an event or a situation, the terms may refer to an example in which an event or a situation occurs accurately and an example in which the event or situation occurs approximately. For example, when being used in combination with a value, the term may refer to a variation range of less than or equal to ±10% of the value, for example, less than or equal to ±5%, less than or equal to ±4%, less than or equal to ±3%, less than or equal to ±2%, less than or equal to ±1%, less than or equal to ±0.5%, less than or equal to ±0.1%, or less than or equal to ±0.05%. For example, if a difference between two values is less than or equal to ±10% of an average value of the value (for example, less than or equal to ±5%, less than or equal to ±4%, less than or equal to ±3%, less than or equal to ±2%, less than or equal to ±1%, less than or equal to ±0.5%, less than or equal to ±0.1%, or less than or equal to ±0.05%), it could be considered that the two values are "substantially" the same. For example, being "substantially" parallel may refer to an angular variation range of less than or equal to ±10° with respect to 0°, for example, less than or equal to ±5°, less than or equal to ±4°, less than or equal to ±3°, less than or equal to ±2°, less than or equal to ±1°, less than or equal to ±0.5°, less than or equal to ±0.1°, or less than or equal to ±0.05°. For example, being "substantially" perpendicular may refer to an angular variation range of less than or equal to ±10° with respect to 90°, for example, less than or equal to ±5°, less than or equal to ±4°, less than or equal to ±3°, less than or equal to ±2°, less than or equal to ±1°, less than or equal to ±0.5°, less than or equal to ±0.1°, or less than or equal to ±0.05°.

As used herein, the singular terms "a", "an", and "the" may include plural referents unless the context clearly dictates otherwise. In the description of some embodiments, assemblies provided "on" or "above" another assembly may encompass a case in which a former assembly is directly on a latter assembly (for example, in physical contact with the latter assembly), and a case in which one or more intermediate assemblies are located between the former assembly and the latter assembly.

Unless otherwise specified, spatial descriptions such as "above", "below", "upper", "left", "right", "lower", "top", "bottom", "vertical", "horizontal", "side", "higher", "lower", "upper portion", "on", "under", and "downward" are indicated relative to the orientations shown in the figures. It should be understood that the space descriptions used herein are merely for illustrative purposes, and actual implementations of the structures described herein may be spatially arranged in any orientation or manner, provided that the advantages of embodiments of the disclosure are not deviated due to such arrangement.

As used herein, the singular terms "a", "an", and "the" may include plural referents unless the context clearly dictates otherwise. In the description of some embodiments, assemblies provided "on" or "above" another assembly may encompass a case in which a former assembly is directly on a latter assembly (for example, in physical contact with the latter assembly), and a case in which one or more intermediate assemblies are located between the former assembly and the latter assembly.

Unless otherwise specified, spatial descriptions such as "above", "below", "upper", "left", "right", "lower", "top", "bottom", "vertical", "horizontal", "side", "higher", "lower", "upper portion", "on", "under", and "downward" are indicated relative to the orientations shown in the figures. It should be understood that the space descriptions used herein are merely for illustrative purposes, and actual implementations of the structures described herein may be spatially arranged in any orientation or manner, provided that the advantages of embodiments of the disclosure are not deviated due to such arrangement.

While the disclosure has been described and illustrated with reference to specific embodiments thereof, these descriptions and illustrations do not limit the disclosure. It should be understood by those skilled in the art that various changes may be made and equivalents may be substituted without departing from the true spirit and scope of the disclosure as defined by the appended claims. The illustrations may not be necessarily drawn to scale. There may be distinctions between the artistic renditions in the disclosure and the actual apparatus due to manufacturing processes and tolerances. There may be other embodiments of the disclosure which are not specifically illustrated. The specification and drawings are to be regarded as illustrative rather than restrictive. Modifications may be made to adapt a particular situation, material, composition of matter, method, or process to the objective, spirit and scope of the disclosure. All such modifications are intended to be within the scope of the claims appended hereto. While the methods disclosed herein have been described with reference to particular operations performed in a particular order, it will be understood that these operations may be combined, sub-divided, or re-ordered to form an equivalent method without departing from the teachings of the disclosure. Therefore, unless otherwise specifically indicated herein, the order and grouping of operations shall not be construed as any limitation on the disclosure.

Several embodiments of the disclosure and features of details are briefly described above. The embodiments described in the disclosure may be easily used as a basis for designing or modifying other processes and structures for realizing the same or similar objectives and/or obtaining the same or similar advantages introduced in the embodiments of the disclosure. Such equivalent construction does not depart from the spirit and scope of the disclosure, and various variations, replacements, and modifications can be made without departing from the spirit and scope of the disclosure.

What is claimed is:

1. A vaporization device comprising:

a housing;

a top cap; and a heating assembly, the housing and the top cap defining a fluid storage compartment and the top cap surrounding the heating assembly, wherein the top cap comprises a first portion and a second portion, the first portion comprising a first material and the second portion comprising a second material, the first material being different from the second material.

2. A vaporization device comprising:

a housing;

a heating assembly; and a top cap engaged with the housing and the heating assembly, wherein the top cap comprises a first portion, a second portion, and a third portion, the first portion and the third portion comprising a first material, and the second portion comprising a second material.

3. The vaporization device according to claim 1, wherein hardness of the first material is less than hardness of the second material.

4. The vaporization device according to claim 1, wherein the first portion comprises an elastic material.

5. The vaporization device according to claim 4, wherein the elastic material comprises liquid silica gel, and Shore hardness of the elastic material is within a range from 40A to 50A.

6. The vaporization device according to claim 1, wherein a bonding force between the first portion and the second portion is within a range from 0.1 $N/cm^2$ (Newton/square millimeter) to 20 $N/cm^2$.

7. The vaporization device according to claim 1, wherein an inner surface of the storage compartment surrounds the first portion, and the first portion surrounds the heating assembly.

8. The vaporization device according to claim 1, wherein the second portion comprises a flange, the first portion being disposed between an inner surface of the storage compartment and the flange.

9. The vaporization device according to claim 1, wherein the second portion comprises a perforation, the first portion comprising a protrusion, and the protrusion penetrating through the second portion through the perforation.

10. The vaporization device according to claim 1, further comprising:

a heating base comprising a first opening, wherein the heating assembly is in communication with external fluid through the first opening; and a filter screen in direct contact with the first opening.

11. The vaporization device according to claim 10, further comprising a first tube, wherein a first end of the first tube defines the first opening, and the first end of the first tube is away from the heating assembly.

12. The vaporization device according to claim 11, further comprising a bottom cap, wherein the filter screen is disposed between the first end of the tube and the bottom cap.

13. The vaporization device according to claim 2, wherein the second portion comprises a perforation, and there is a protrusion between the first portion and the third portion, the protrusion being disposed in the perforation.

14. The vaporization device according to claim 2, further comprising:

a bottom cap disposed at a bottom of the housing, wherein the bottom cap comprises a plurality of holes, diameters of the holes being within a range from 0.01 mm to 0.2 mm.

15. The vaporization device according to claim 2, wherein the first material comprises liquid silica gel, and Shore hardness of the first material is within a range from 40A to 50A.

16. The vaporization device according to claim 2, wherein the second portion of the top cap comprises a first opening and a second opening, the first portion of the top cap is disposed on an outer side of the first opening, and the third portion of the top cap is disposed on an inner side of the second opening.

17. The vaporization device according to claim 2, wherein the first portion of the top cap is integrally formed with the third portion.

18. The vaporization device according to claim 2, wherein an inner surface of the housing surrounds the first portion, and the third portion surrounds the heating assembly.

19. The vaporization device according to claim 2, wherein the second portion comprises a flange, and the first portion is located between an inner surface of the housing and the flange.

* * * * *